US010712690B2

(12) United States Patent
Miyamoto et al.

(10) Patent No.: US 10,712,690 B2
(45) Date of Patent: Jul. 14, 2020

(54) IMAGE FORMING APPARATUS HAVING TRANSFER UNIT

(71) Applicant: FUJI XEROX CO., LTD., Tokyo (JP)

(72) Inventors: Yoko Miyamoto, Kanagawa (JP); Noboru Hirakawa, Kanagawa (JP); Yasuhiro Shimada, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/970,848

(22) Filed: May 3, 2018

(65) Prior Publication Data

US 2019/0107798 A1 Apr. 11, 2019

(30) Foreign Application Priority Data

Oct. 11, 2017 (JP) ..... 2017-197572

(51) Int. Cl.
*G03G 15/16* (2006.01)
*G03G 15/00* (2006.01)

(52) U.S. Cl.
CPC ..... *G03G 15/1675* (2013.01); *G03G 15/1695* (2013.01); *G03G 15/5029* (2013.01); *G03G 15/161* (2013.01)

(58) Field of Classification Search
CPC ..... G03G 15/1675; G03G 15/1605; G03G 15/5029; G03G 15/6558; G03G 15/657; G03G 15/6588; G03G 2215/00409; G03G 2215/00413; G03G 2215/00763
USPC ..... 399/45, 66, 314, 316, 389
See application file for complete search history.

(56) References Cited

U.S. PATENT DOCUMENTS 5,717,980 A * 2/1998 Oka ..... G03G 15/1645 399/316
6,205,299 B1 * 3/2001 Kusaka ..... G03G 15/1675 399/45
7,346,287 B2 * 3/2008 Ogiyama ..... G03G 15/167 399/66
2017/0277120 A1 * 9/2017 Miyoshi ..... G03G 21/203

FOREIGN PATENT DOCUMENTS

JP 07036287 A * 2/1995
JP 09297476 A * 11/1997
JP 09329977 A * 12/1997
(Continued)

*Primary Examiner* — Robert B Beatty
(74) *Attorney, Agent, or Firm* — JCIPRNET

(57) ABSTRACT

An image forming apparatus includes a transfer unit, a contact unit, and a constant-current controller. The transfer unit nips a recording medium using an image retaining unit and a transfer member and generates a transfer electric field in a transfer region therebetween so as to electrostatically transfer the image onto the recording medium. The contact unit is provided upstream and downstream of the transfer region in a recording-medium transport direction and comes into contact with the recording medium while the recording medium passes through the transfer region, so as to function as an electrode leading to a ground. The constant-current controller performs constant-current control on a transfer current to be fed to the transfer region by using a transfer voltage when the recording medium is a low-resistance recording medium having a predetermined resistance value or lower or having an electrically-conductive layer along a medium base surface.

10 Claims, 10 Drawing Sheets

(56) References Cited

FOREIGN PATENT DOCUMENTS

| | | | | |
|---|---|---|---|---|
| JP | 2000-221810 | | | 8/2000 |
| JP | 2001331046 | A | * | 11/2001 |
| JP | 2004099280 | A | * | 4/2004 |
| JP | 2010-008926 | | | 1/2010 |
| JP | 2010-134184 | | | 6/2010 |
| JP | 2010176023 | A | * | 8/2010 |

* cited by examiner

IMAGE FORMING APPARATUS HAVING TRANSFER UNIT

CROSS-REFERENCE TO RELATED APPLICATIONS

This application is based on and claims priority under 35 USC 119 from Japanese Patent Application No. 2017-197572 filed Oct. 11, 2017.

BACKGROUND

Technical Field

The present invention relates to image forming apparatuses.

SUMMARY

According to an aspect of the invention, there is provided an image forming apparatus including a transfer unit, a contact unit, and a constant-current controller. The transfer unit nips a recording medium by using an image retaining unit, which retains an image by using a charged imaging particle, and a transfer member and generates a transfer electric field in a transfer region between the image retaining unit and the transfer member so as to electrostatically transfer the image retained by the image retaining unit onto the recording medium. The contact unit is provided at an upstream side and a downstream side of the transfer region in a transport direction of the recording medium and comes into contact with the recording medium while the recording medium passes through the transfer region, so as to function as an electrode leading to a ground. The constant-current controller performs constant-current control on a transfer current to be fed to the transfer region by using a transfer voltage applied from a transfer power source in a condition in which the recording medium is a low-resistance recording medium having a predetermined resistance value or lower or having an electrically-conductive layer along a medium base surface.

BRIEF DESCRIPTION OF THE DRAWINGS

Exemplary embodiments of the present invention will be described in detail based on the following figures, wherein.

DETAILED DESCRIPTION

Figure 1:
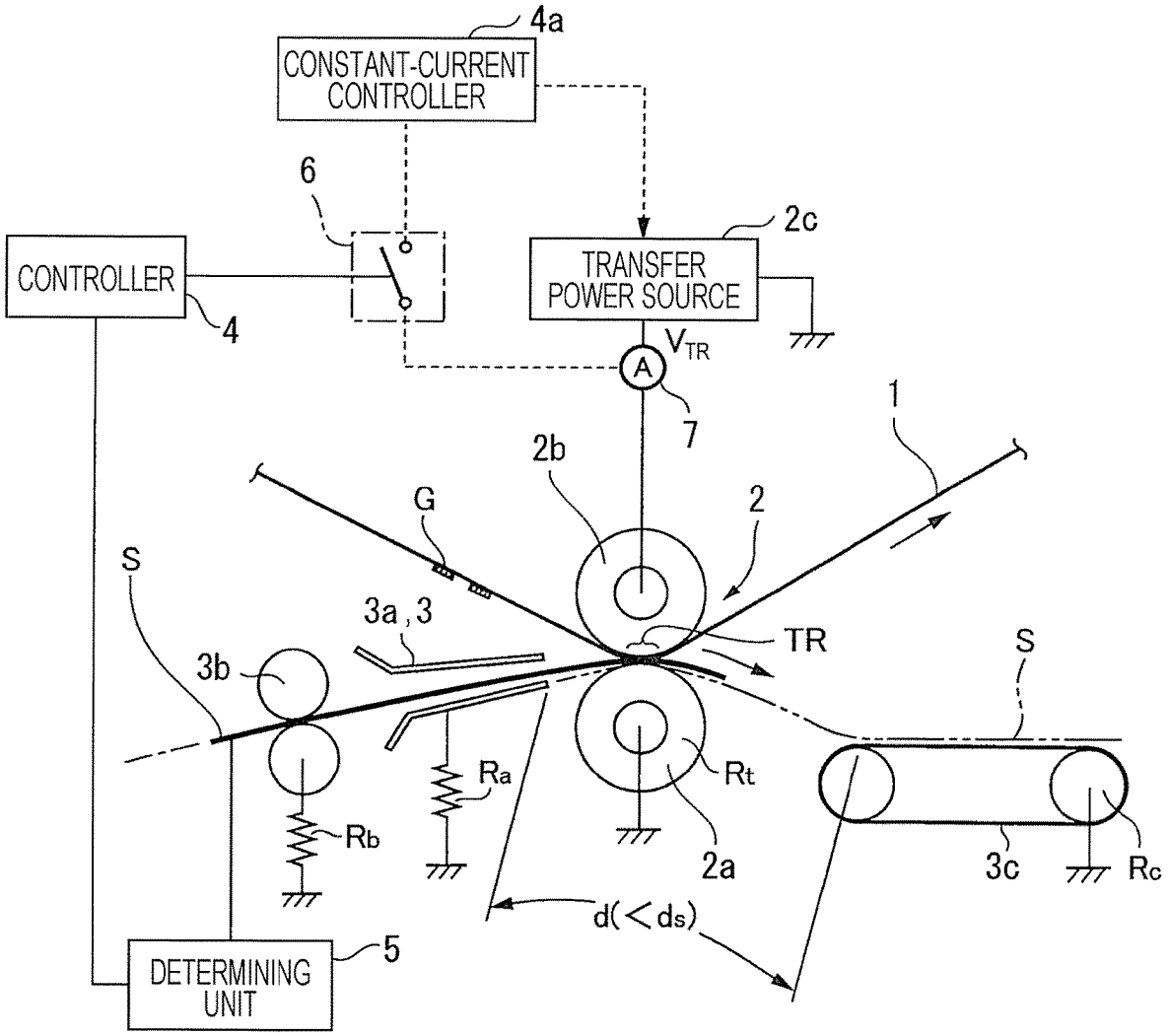
FIG. 1 schematically illustrates an image forming apparatus according to an exemplary embodiment of the present invention.

FIG. 1 schematically illustrates an image forming apparatus according to an exemplary embodiment of the present invention.

In FIG. 1, the image forming apparatus includes a transfer unit 2, a contact unit 3, and a constant-current controller 4*a*. The transfer unit 2 nips a recording medium S by using an image retaining unit 1, which retains an image G thereon using charged imaging particles, and a transfer member 2*a* and generates a transfer electric field in a transfer region TR between the image retaining unit 1 and the transfer member 2*a* so as to electrostatically transfer the image G retained by the image retaining unit 1 onto the recording medium S. The contact unit 3 is disposed upstream and downstream of the transfer region TR in the transport direction of the recording medium S and comes into contact with the recording medium S, while the recording medium S passes through the transfer region TR, so as to function as an electrode leading to the ground. In a condition in which the recording medium S is a low-resistance recording medium having a predetermined resistance value or lower or having an electrically-conductive layer along the medium base surface, the constant-current controller 4*a* performs constant-current control on a transfer current to be fed to the transfer region TR by using a transfer voltage $V_{TR}$ applied from a transfer power source 2*c*.

In FIG. 1, the transfer unit 2 has an opposing member 2*b* disposed facing the transfer member 2*a* at the back surface of the image retaining unit 1 and applies a transfer voltage to the opposing member 2*b* from the transfer power source 2*c* so as to generate a transfer electric field for transferring an image to the transfer region TR. A controller 4 determines whether or not it is necessary to use the constant-current controller 4*a* depending on the type of recording medium S.

In such a technical solution, this exemplary embodiment is intended to improve the transfer performance with respect to a low-resistance recording medium S. Although the type of recording medium may be selected as appropriate, the exemplary embodiment is effective especially when adding a low-resistance recording medium, such as a metallic sheet, as a transfer target.

In this example, the image retaining unit 1 may be an intermediate transfer member of an intermediate transfer type or a dielectric member of a direct transfer type, so long as the image retaining unit 1 is configured to retain an image G thereon.

The transfer unit 2 has the transfer member 2*a* that comes into contact with the recording medium S, and the transfer member 2*a* may be a roller-shaped member or a belt-shaped member so long as the transfer member 2*a* has a function for nipping and transporting the recording medium S in cooperation with the image retaining unit 1 and a function for causing a transfer electric field to occur in the transfer region TR between the transfer member 2*a* and the image retaining unit 1.

Furthermore, although the transfer unit 2 of a widely-used type has the opposing member 2*b* disposed facing the transfer member 2*a* at the back surface of the image retaining unit 1, the transfer unit 2 is not limited to this type and may include a type in which an image electrode is incorporated in the image retaining unit 1.

Moreover, a low-resistance recording medium S may be a recording medium having a predetermined resistance value or lower or may be a recording medium having an electrically-conductive layer along the medium base surface. The latter may sometimes be included in the former, but is sometimes not included in the former, such as a case where the recording medium has a high-resistance surface layer (the resistance thereof being measured using a measuring technique set in accordance with the Japanese Industrial Standards (JIS)). However, even if the latter is not included in the former, since the recording medium often apparently shows a low-resistance behavior in which a high transfer voltage applied thereto travels in the planar direction, such a recording medium is also treated as a low-resistance recording medium.

The contact unit 3 widely includes a direct grounded type, a resistance grounded type, and a bias grounded type so long as the contact unit 3 is of a type other than a non-grounded (floating) type. Furthermore, the contact unit 3 may include at least one member provided at each of the inlet and outlet sides of the transfer region TR such that at least one of the members of the contact unit 3 comes into contact with the recording medium S, while the recording medium S passes through the transfer region TR, so as to function as an electrode leading to the ground. In this example, the contact unit 3 includes multiple contact members 3*a* and 3*b* at the upstream side of the transfer region TR in the transport direction of the recording medium S, and also includes a single contact member 3*c* at the downstream side of the transfer region TR in the transport direction of the recording medium S. The contact member 3*a* is a guide member that guides the recording medium S along a transport path, and the contact member 3*b* is a positioning member that positions the recording medium S. The contact member 3*c* is, for example, a belt-shaped transport member that transports the recording medium S. In FIG. 1, the recording medium S denoted by a solid line is in contact with the contact members 3*a* and 3*b*, and the recording medium S denoted by an imaginary line is in contact with the contact member 3*c*.

Furthermore, in this exemplary embodiment, if a low-resistance recording medium S is to be used, the constant-current controller 4*a* causes a constant transfer current to flow to the transfer region TR.

Normally, in order to transfer charged imaging particles (such as toner) to the recording medium S from the image retaining unit 1, such as an intermediate transfer member, it is necessary to stably generate an optimal electric field for the type of the recording medium S (1), the width of the recording medium S (2), and the resistance of the transfer member 2*a* (3), which are variable. For achieving this, there are constant-voltage control and constant-current control. In constant-voltage control, the optimal voltage varies due to being affected by the type of the recording medium S (1) and the resistance of the transfer member 2*a* (3), but is not affected by the width of the recording medium S (2). In constant-current control, the optimal voltage is affected by the width of the recording medium S (2), and the way in which the optimal voltage is affected varies depending on the resistance of the transfer member 2*a* (3). However, the optimal voltage is basically less likely to be affected by the type of the recording medium S (1) and the resistance of the transfer member 2*a* (3).

Normally, constant-voltage control is often employed as a control method for the recording medium S. This is because, even in constant-current control, the type of the recording medium S (1) and the resistance of the transfer member 2*a* (3) are not made completely ineffective, whereas at least the width of the recording medium S (2) is reliably made ineffective in constant-voltage control.

With reference to an example in which a low-resistance recording medium S has an electrically-conductive layer along the medium base surface, assuming that a constant transfer voltage is applied to the recording medium S, the recording medium S would have the same electric potential at any location within the surface thereof, so that the transfer voltage would spread over the entire surface of the recording medium S during the transfer process. This implies that there is a possibility of leakage of the transfer current to all members of the contact unit 3 (e.g., the contact members 3*a* to 3*c*) existing in the entire surface range of the recording medium S. The member receiving the leakage and the amount of leakage depend on the position of the recording medium S being transported and the resistance values of the contact members 3*a* to 3*c* and sequentially change in accordance with the transporting process of the recording medium S. Accordingly, in a case where a low-resistance recording medium S is used, since the impedance of the current path through which the transfer current flows changes in accordance with the transporting process of the recording medium S, there is a high possibility that the transfer electric field of the transfer region TR may change when the constant-voltage control method of applying a constant transfer voltage is employed.

In this exemplary embodiment, the constant-current controller 4*a* performs constant-current control when a low-resistance recording medium S is used, so that even if the impedance of the current path through which the transfer current flows changes in accordance with the transporting process of the recording medium S, a constant transfer current flows to the transfer region TR, whereby a stable transfer electric field is constantly generated.

This situation also occurs in a low-resistance recording medium, such as black paper, containing a large amount of an electrically-conductive material, such as carbon black.

Next, a representative example of the image forming apparatus according to this exemplary embodiment will be described.

One representative example of the image forming apparatus when a freely-chosen type of recording medium S is used has a determining unit 5 that is capable of determining the type of recording medium S traveling toward the transfer region TR and determines whether or not the constant-current controller 4*a* is necessary based on a determination signal of the determining unit 5.

A representative example of the determining unit 5 is a detector that detects whether or not the traveling recording medium S is a low-resistance recording medium. In this example, it is desirable that the determining unit 5 is capable of determining a low-resistance recording medium S while the recording medium S is traveling.

A representative example that determines whether or not the constant-current controller 4*a* is necessary includes a selecting unit 6 that selects the constant-current controller 4*a* when the recording medium S is a low-resistance recording medium and that selects a constant-voltage controller (which includes the transfer power source 2*c* in this example) when the recording medium S is not a low-resistance recording medium.

In this example, if the constant-current controller 4*a* is selected, a detector 7 may detect the transfer current flowing to the transfer region TR, and the transfer voltage $V_{TR}$ of the transfer power source 2*c* may be controlled based on the detection signal such that the transfer current becomes a constant current.

Furthermore, as shown in FIG. 1, as desirable grounding conditions for the contact unit 3, resistance values (e.g., Ra, Rb, and Rc) leading to the ground for the contact unit 3 (e.g., contact members 3*a*, 3*b*, and 3*c*) are lower than a resistance value Rt of the transfer member 2*a* of the transfer unit 2. In addition to being effective when causing a transfer current to flow from the contact unit 3 to the ground via a low-resistance recording medium S, this example suppresses a leakage of electric current to the transfer member 2*a* from a non-passing section of the recording medium S in the transfer region TR.

Moreover, as a desirable layout of the contact unit 3 at the inlet and outlet sides of the transfer region TR, the members of the contact unit 3 provided at the upstream side and the downstream side of the transfer region TR in the transport direction of the recording medium S are separated from each other by a distance d that is shorter than a length ds of the recording medium S in the transport direction. In addition to being effective when causing a transfer current to flow from the contact unit 3 to the ground over the entire length of a low-resistance recording medium S in a state where the recording medium S extends astride the members of the contact unit 3 disposed at the inlet and outlet sides of the transfer region TR, this example suppresses a leakage of electric current to a non-passing section of the recording medium S in a region other than the contact region between the recording medium S and the contact unit 3.

Furthermore, when a low-resistance recording medium S passes through the transfer region TR, the recording medium S causes at least the contact unit 3 (i.e., the contact members 3*a* and 3*b* in this example) located at the inlet side of the transfer region TR and the contact unit 3 (i.e., the contact member 3*c* in this example) located at the outlet side of the transfer region TR to function as an electrode leading to the ground. In addition to being effective when causing a transfer current to flow to the ground from at least one of the members of the contact unit 3 disposed at the inlet and outlet sides of the transfer region TR, this example prevents the transfer current from flowing toward the transfer member 2*a* and causes a sufficient amount of constant transfer current to flow as a transfer electric field to the entire surface of the low-resistance recording medium S, thereby achieving a stable image.

When a low-resistance recording medium S is used, the transfer unit 2 may switch the transfer member 2*a* from a grounded state to a non-grounded state. In this example, the transfer member 2*a* is switched to a non-grounded state when a low-resistance recording medium S is used, so that the current path to the transfer member 2*a* is blocked off. This is effective for causing the transfer current of the transfer region TR to stably and entirely flow to the ground from the contact unit 3 located at the inlet and outlet sides of the transfer region TR without flowing to the transfer member 2*a*, thereby achieving a stable image over the entire surface of the recording medium S.

In this exemplary embodiment, a method of generating a transfer electric field in accordance with constant-current control with respect to a low-resistance recording medium S is employed. When employing this method, a second-transfer section desirably includes the following components.

Specifically, as shown in FIG. 1, the components include the transfer unit 2 and the contact unit 3. The transfer unit 2 nips the recording medium S by using the image retaining unit 1, which retains the image G thereon using charged imaging particles, and the transfer member 2*a* and generates a transfer electric field, from the image retaining unit 1 side, in the transfer region TR between the image retaining unit 1 and the transfer member 2*a* so as to electrostatically transfer the image G retained by the image retaining unit 1 onto the recording medium S. The contact unit 3 includes at least one member provided at each of the upstream and downstream sides of the transfer region TR of the transfer unit 2 in the transport direction of the recording medium S such that at least one of the members comes into contact with the recording medium S, while the recording medium S passes through the transfer region TR, so as to function as an electrode leading to the ground. The resistance values Ra to Rc leading to the ground for the contact unit 3 are set to be lower than the resistance value Rt of the transfer member 2*a* of the transfer unit 2, and the members of the contact unit 3 disposed upstream and downstream of the transfer region TR in the transport direction of the recording medium S are separated from each other by the distance d that is shorter than the length ds of the recording medium S in the transport direction.

First Exemplary Embodiment

Exemplary embodiments of the present invention will be described below in further detail with reference to the appended drawings.

Figure 2:
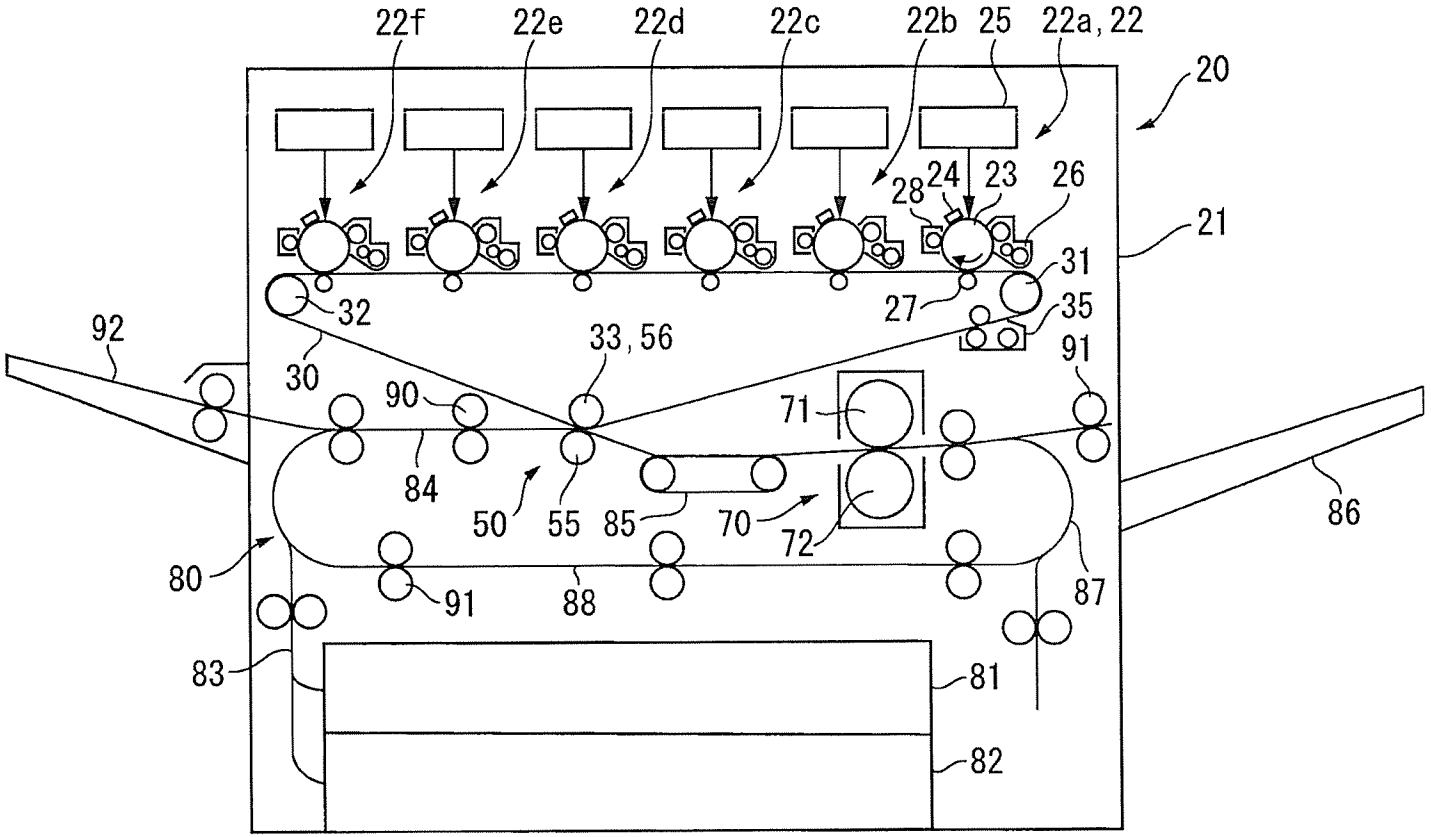
FIG. 2 illustrates the overall configuration of an image forming apparatus according to a first exemplary embodiment.

FIG. 2 illustrates the overall configuration of an image forming apparatus according to a first exemplary embodiment.

Overall Configuration of Image Forming Apparatus

In FIG. 2, an image forming apparatus 20 has an image forming apparatus housing 21 that contains therein: image forming sections 22 (i.e., 22*a* to 22*f*) that form images of multiple color components (i.e., white #1, yellow, magenta, cyan, black, and white #2); a belt-shaped intermediate transfer member 30 that retains the sequentially-transferred (first-transferred) color component images formed at the image forming sections 22; a second-transfer device (collective transfer device) 50 that second-transfers (collectively transfers) the color component images transferred on the intermediate transfer member 30 onto a sheet S as a recording medium; a fixing device 70 that fixes the second-transferred images onto the sheet S; and a sheet transport system 80 that transports the sheet S to a second-transfer region. Although exactly the same white color material is used as white #1 and white #2 in this example, different white color materials may be used depending on whether the white color materials are located below or above another color component image on the sheet S. Moreover, for example, a transparent material may be used in place of white #1.

Image Forming Sections

In this exemplary embodiment, each of the image forming sections 22 (22*a* to 22*f*) has a drum-shaped photoconductor 23, and the photoconductor 23 is surrounded by a charging device 24 such as a corotron or a transfer roller that electrostatically charges the photoconductor 23, an exposure device 25 such as a laser scanning device that writes an electrostatic latent image onto the electrostatically-charged photoconductor 23, a developing device 26 that uses the corresponding color component toner to develop the electrostatic latent image written on the photoconductor 23, a first-transfer device 27 such as a transfer roller that transfers the toner image on the photoconductor 23 onto the intermediate transfer member 30, and a photoconductor cleaning device 28 that removes residual toner from the photoconductor 23.

The intermediate transfer member 30 is wrapped around multiple (three in this exemplary embodiment) tension rollers 31 to 33. For example, the tension roller 31 is used as a drive roller driven by a drive motor (not shown), and the intermediate transfer member 30 is moved in a circulating manner by the drive roller. Moreover, an intermediate-transfer-member cleaning device 35 for removing residual toner from the intermediate transfer member 30 after a second-transfer process is provided between the tension rollers 31 and 33.

Second-Transfer Device (Collective Transfer Device)

Figure 3:
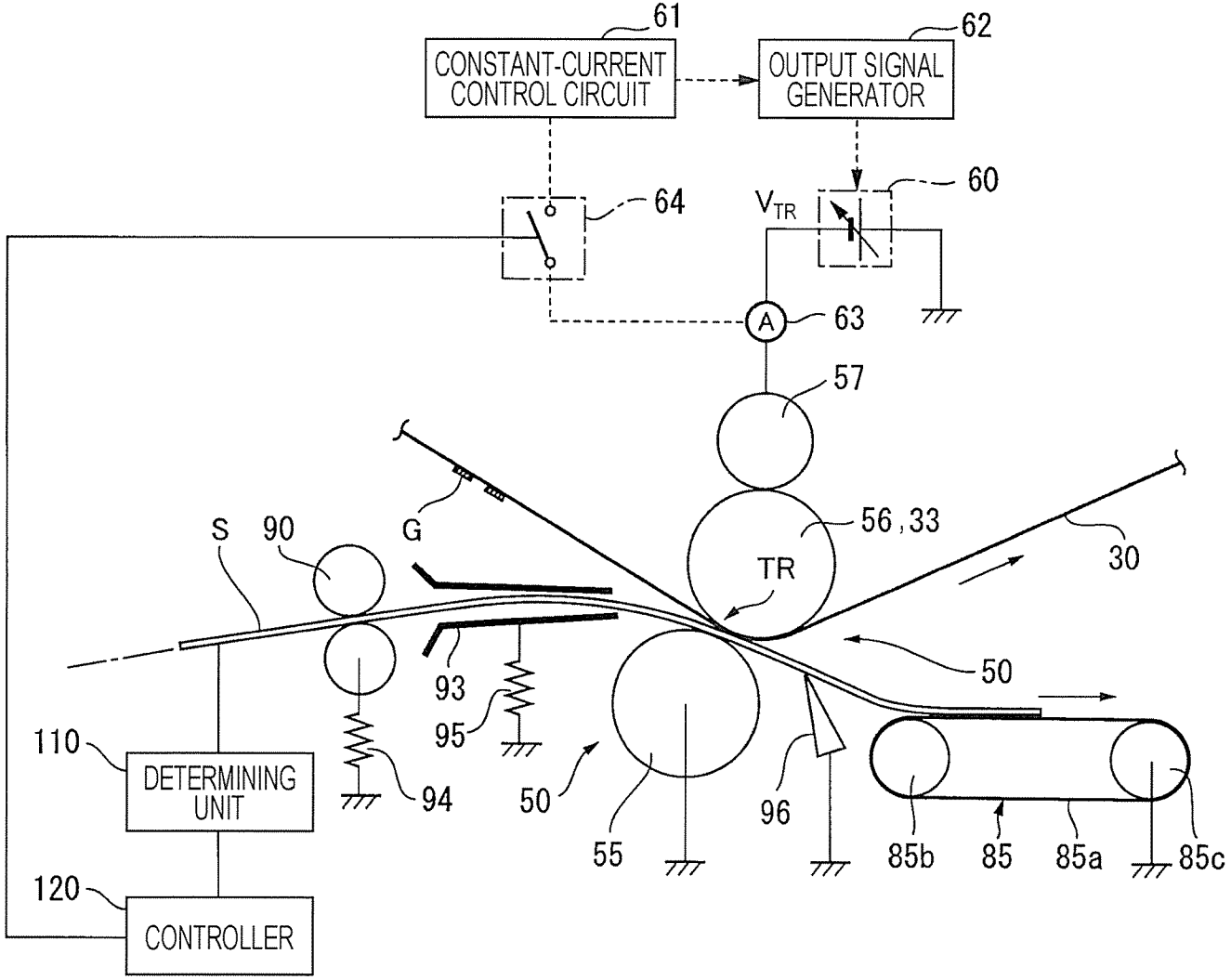
FIG. 3 illustrates a detailed configuration of and around a second-transfer section of the image forming apparatus shown in FIG. 2.

Furthermore, as shown in FIGS. 2 and 3, the second-transfer device (collective transfer device) 50 includes a transfer roller 55 disposed in pressure contact with a section facing the tension roller 33 for the intermediate transfer member 30. Moreover, the tension roller 33 for the intermediate transfer member 30 serves as an opposing roller 56 functioning as a counter electrode for the transfer roller 55. In this example, the transfer roller 55 is formed by coating a metallic shaft with an elastic layer, which is obtained by blending carbon black with foamed urethane rubber or ethylene-propylene rubber (EPDM). A nip region of the intermediate transfer member 30 nipped between the transfer roller 55 and the opposing roller 56 functions as a second-transfer region (collective transfer region) TR.

Furthermore, the opposing roller 56 (also serving as the tension roller 33 in this example) is supplied with a transfer voltage $V_{TR}$ from a transfer power source 60 via an electrically-conductive feed roller 57, so that a predetermined transfer electric field is generated between the elastic transfer roller 55 and the opposing roller 56.

In this example, the transfer power source 60 is capable of selecting between constant-voltage control and constant-current control. Specifically, in the transfer power source 60, the transfer voltage $V_{TR}$ is set in an adjustable manner based on a signal from an output signal generator 62, and the output signal generator 62 is connected to a constant-current control circuit 61. A feedback ammeter 63 is connected in series between the transfer power source 60 and the feed roller 57, a feedback current path is provided between the ammeter 63 and the constant-current control circuit 61, and a selection switch 64 is provided at an intermediate location of this feedback current path. By turning the selection switch 64 on or off, it is selected whether or not feedback-based constant-current control is to be performed. When the selection switch 64 is turned on, an electric current value monitored at the ammeter 63 is fed back to the output signal generator 62 via the constant-current control circuit 61, and the transfer voltage $V_{TR}$ in the transfer power source 60 is set in an adjustable manner such that a transfer current $I_{TR}$ in the second-transfer region TR becomes a constant current.

Although the transfer roller 55 is disposed in pressure contact with the intermediate transfer member 30 in the second-transfer device 50 in this example, a belt transfer module configured by wrapping a transfer belt between tension rollers, one of which is served by the transfer roller 55, may be used as an alternative.

Fixing Device

As shown in FIG. 2, the fixing device 70 has a thermal fixing roller 71 that is disposed in contact with the image retaining surface of the sheet S and that is rotationally drivable, and also has a pressure fixing roller 72 that is disposed in pressure contact with the thermal fixing roller 71 and that is rotated by being slave-driven by the thermal fixing roller 71. The fixing device 70 causes an image retained on the sheet S to pass through a fixing region between the two fixing rollers 71 and 72 so as to fix the image thereon using heat and pressure.

Sheet Transport System

As shown in FIGS. 2 and 3, the sheet transport system 80 has multiple levels (two levels in this example) of sheet feed containers 81 and 82. The sheet transport system 80 transports a sheet S fed from one of the sheet feed containers 81 and 82 to the second-transfer region TR via a vertical transport path 83 extending substantially in the vertical direction and a horizontal transport path 84 extending substantially in the horizontal direction, subsequently transports the sheet S having a transferred image retained thereon to the fixing region of the fixing device 70 via a transport belt 85, and outputs the sheet S to a sheet output tray 86 provided at one side of the image forming apparatus housing 21.

Furthermore, the sheet transport system 80 has a branch transport path 87 that branches off downward from a point of the horizontal transport path 84 located downstream of the fixing device 70 in the sheet transport direction and that is capable of inverting the sheet S. The sheet transport system 80 returns the sheet S inverted in the branch transport path 87 to the horizontal transport path 84 from the vertical transport path 83 via a transport path 88, allows another image to be transferred onto the back face of the sheet S in the second-transfer region TR, and outputs the sheet S to the sheet output tray 86 via the fixing device 70.

In addition to a positioning roller 90 that positions the sheet S and feeds the sheet S to the second-transfer region TR, the sheet transport system 80 is also provided with an appropriate number of transport rollers 91 in the transport paths 83, 84, 87, and 88.

Moreover, at the opposite side from the sheet output tray 86, the image forming apparatus housing 21 is provided with a manual sheet feeder 92 used for manually feeding a sheet S toward the horizontal transport path 84.

Furthermore, at the inlet side of the second-transfer region TR, the horizontal transport path 84 is provided with a guide chute 93 that guides the sheet S that has passed through the positioning roller 90 toward the second-transfer region TR. In this example, a single guide chute 93 is provided between the positioning roller 90 and the second-transfer region TR and is constituted of a pair of metallic chute components that are disposed facing each other, so as to regulate the guide path for the sheet S.

As an alternative to this example in which a single guide chute 93 is provided between the positioning roller 90 and the second-transfer region TR, multiple (e.g., two) guide chutes 93 may be provided. In the case where multiple guide chute 93 are provided, the guide chutes 93 may be disposed at different angles and positions from each other, thus increasing the degree of freedom for adjusting the guide path for the sheet S.

Moreover, at the outlet side of the second-transfer region TR, an antistatic needle 96 as a static eliminating member is provided between the second-transfer region TR and the transport belt 85. When the sheet S is disposed close to the antistatic needle 96 after the second-transfer process, the antistatic needle 96 discharges the electric charge from the electrostatically-charged sheet S so as to remove static electricity therefrom.

Sheet Type

A sheet S usable in this example may be, for example, plain paper with a surface resistance of $10^{10}$ to $10^{12}$ a/sq. or a low-resistance sheet Sm with a surface resistance lower than that of plain paper.

Figure 4A:
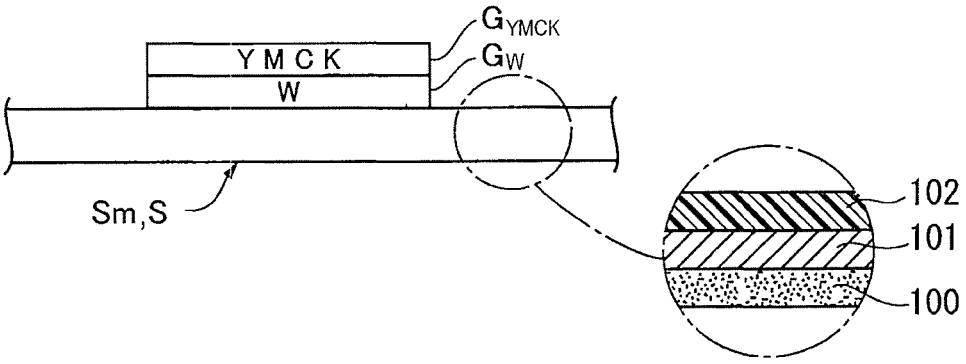
FIGS. 4A and 4B respectively illustrate a first example and a second example of an image formed on a low-resistance sheet by the image forming apparatus according to the first exemplary embodiment.

A representative example of a low-resistance sheet Sm is, for example, a so-called metallic sheet formed by stacking a metallic layer composed of aluminum (e.g., an aluminum deposited surface) 101 on a base layer 100 composed of a sheet base material and coating the metallic layer 101 with a surface layer 102 composed of synthetic resin, such as polyethylene terephthalate (PET), as shown in FIG. 4A. An adhesive layer composed of, for example, PET is provided between the base layer 100 and the metallic layer 101.

Although a metallic sheet of this type may have a predetermined surface resistance value (e.g., $10^6$ to $10^7$ Ω/sq.), the actual resistance value measured in accordance with the surface resistance measuring technique complying with JIS does not fall below the threshold value or lower, as in the above-mentioned metallic sheet including the surface layer 102 composed of a high resistance material, and there are types of metallic sheets that substantially act as a low-resistance sheet when the transfer voltage $V_{TR}$ is applied thereto.

Figure 4B:
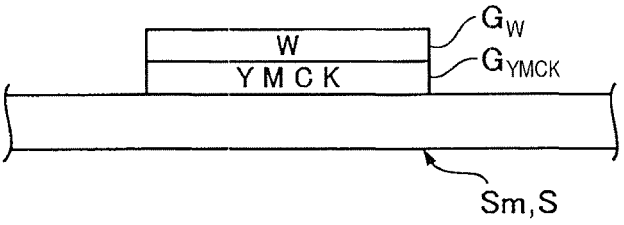

It is also possible to form a color image constituted of, for example, YMCK (yellow, magenta, cyan, and black) colors directly on a metallic sheet serving as a low-resistance sheet Sm of this type. For example, as shown in FIG. 4A, a white image $G_W$ as a background image using white W may be formed on the metallic sheet by using the image forming section 22*f* shown in FIG. 2, and a color image $G_{YMCK}$ using YMCK may be formed on the white image $G_W$ by using the image forming sections 22*b* to 22*e* shown in FIG. 2. As another alternative, as shown in FIG. 4B, a color image $G_{YMCK}$ using YMCK may be formed on the metallic sheet by using the image forming sections 22*b* to 22*e* shown in FIG. 2, and a white image $G_W$ using white W may be formed on the color image $G_{YMCK}$ by using the image forming section 22*a* shown in FIG. 2.

Examples of the low-resistance sheet Sm include black paper containing an electrically-conductive material, such as carbon black, and black coated paper in which a coating layer containing an electrically-conductive material, such as carbon black, is formed on a normal paperboard.

Configuration Example of Determining Unit

Figure 4C:
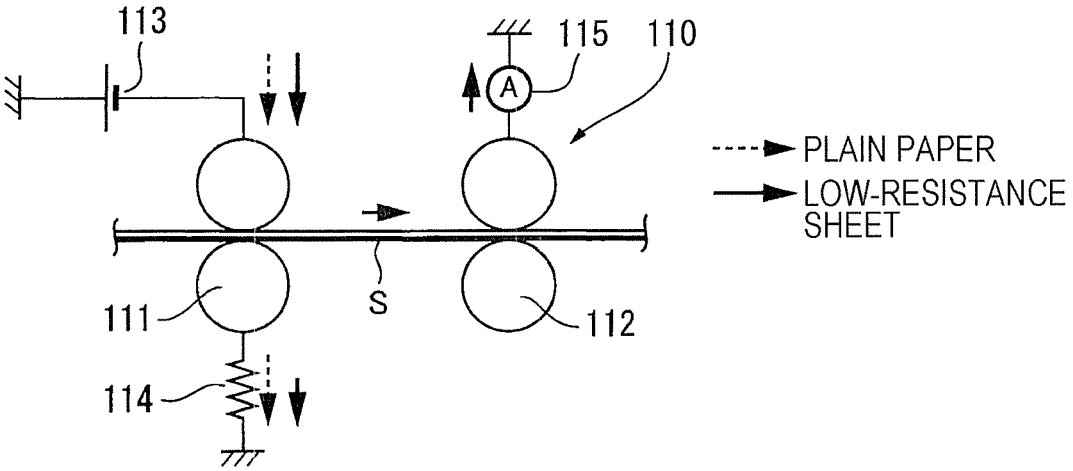
FIG. 4C illustrates an example of a determining unit shown in FIG. 3.

As shown in FIG. 3, in this example, a determining unit 110 for determining the sheet type is provided at one location on the vertical transport path 83 or the horizontal transport path 84 of the sheet transport system 80. For example, as shown in FIG. 4C, the determining unit 110 is provided with pairs of determination rollers 111 and 112 arranged side-by-side in the transport direction of the sheet S. One of the determination rollers 111 in the pair located at the upstream side in the transport direction of the sheet S is connected to a determination power source 113, whereas the other determination roller 111 is connected to ground via a resistor 114, and an ammeter 115 is provided between one of the determination rollers 112 in the pair located at the downstream side in the transport direction of the sheet S and the ground. The determination rollers 111 and 112 may also function as transport members (i.e., the positioning roller 90 and the transport rollers 91) for the sheet S or may be provided separately from the transport members.

In this example, supposing that plain paper (including a high-resistance sheet other than a low-resistance sheet) is used as the sheet S, since the surface resistance of plain paper is high to a certain extent, the determination current from the determination power source 113 flows across the pair of determination rollers 111, as indicated by a dotted line in FIG. 4C, even when the plain paper is disposed astride the pairs of determination rollers 111 and 112, such that the determination current hardly reaches the ammeter 115 at the determination roller 112 side via the sheet S.

In contrast, supposing that a low-resistance sheet, such as a metallic sheet, is used as the sheet S, since the surface resistance of a low-resistance sheet is lower than that of plain paper, when the low-resistance sheet is disposed astride the pairs of determination rollers 111 and 112, a portion of the determination current from the determination power source 113 flows across the pair of determination rollers 111, as indicated by a solid line in FIG. 4C, and the remaining portion of the determination current reaches the ammeter 115 at the determination roller 112 side via the sheet S. Then, the surface resistance of the sheet S is calculated in accordance with the electric current measured by the ammeter 115 and the voltage applied from the determination power source 113, whereby the sheet type is determined.

As an alternative to this example in which the determining unit 110 determines the sheet type by measuring the surface resistance of the sheet S being transported, for example, the sheet type may be determined based on a designation signal when the user designates the sheet type, or the sheet type (especially, a metallic sheet type) may be determined by using a light reflective sensor provided in the sheet transport path.

Figure 5A:
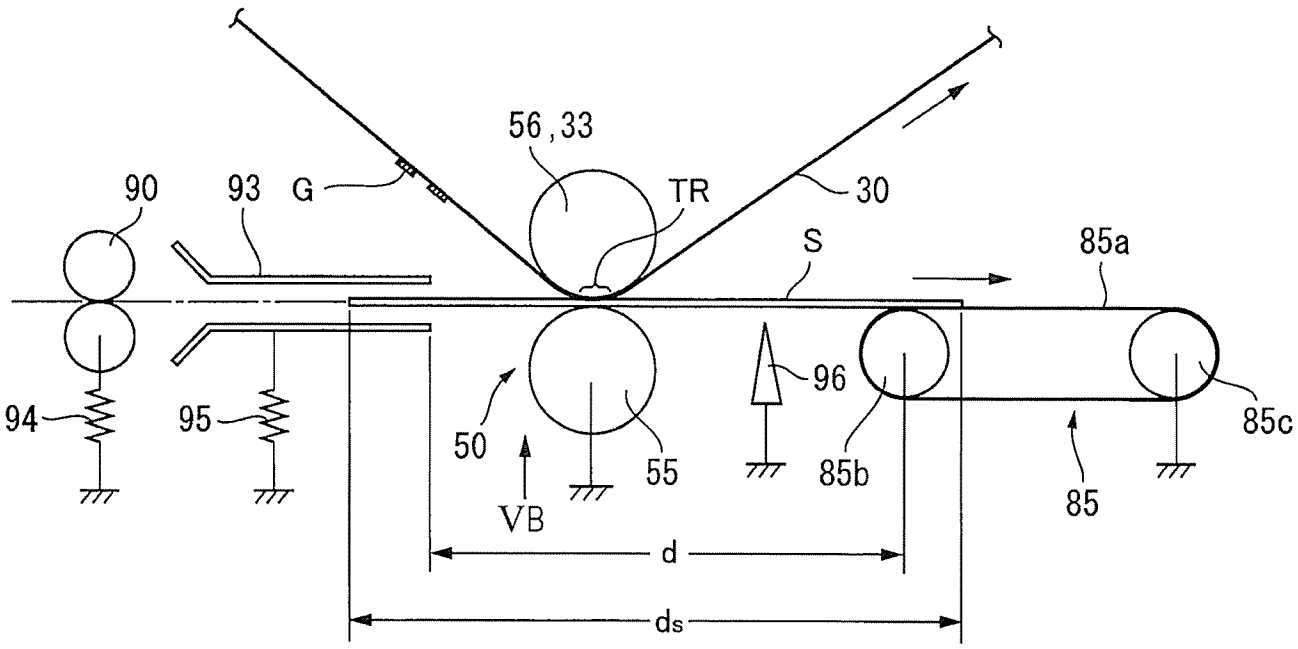
FIG. 5A illustrates a layout example of components in and around the second-transfer section used in the first exemplary embodiment.

Sheet Contact Members Located at Inlet and Outlet Sides of Second-Transfer Region In this exemplary embodiment, as shown in FIGS. 3 and 5A, sheet contact members located at the inlet and outlet sides of the second-transfer region TR include the guide chute 93 and the positioning roller 90 at the inlet side of the second-transfer region TR and the transport belt 85 at the outlet side of the second-transfer region TR.

In this example, the positioning roller 90 is constituted of a metallic roller and is connected to ground via a resistor 94. The guide chute 93 is constituted of metallic chute components that are connected to ground via a resistor 95. The resistor 94 selected for the positioning roller 90 and the resistor 95 selected for the guide chute 93 have resistance values lower than that of the transfer roller 55 (volume resistivity in this example).

As an alternative to this example in which the resistors 94 and 95 are selected by comparing the resistance values thereof with the resistance value of the transfer roller 55, if the second-transfer device 50 is, for example, a belt transfer module, the resistors 94 and 95 may be selected by comparing the resistance values thereof with the resistance value from the belt transfer module to the ground. Furthermore, as an alternative to this example in which a resistance grounding method of connecting the positioning roller 90 and the guide chute 93 to ground via the resistors 94 and 95 is employed, the positioning roller 90 and the guide chute 93 may be directly connected to ground.

Furthermore, in this example, the transport belt 85 is constituted of, for example, a belt member 85*a* composed of electrically-conductive rubber and tensely wrapped between a pair of tension rollers 85*b* and 85*c*. At least one of the tension rollers 85*b* and 85*c* (e.g., 85*c*) is composed of metal, electrically-conductive resin, or a combination of these materials, and the cored bar of the tension roller is directly connected to ground.

Although the antistatic needle 96 is not necessarily a contact member that always comes into contact with the sheet S, the antistatic needle 96 is directly connected to ground. Therefore, when the sheet S that has passed through the second-transfer region TR moves close to the antistatic needle 96, a discharge phenomenon occurs between the two, whereby static electricity is removed from the sheet S.

Furthermore, in this exemplary embodiment, the length d of the sheet transport path between the guide chute 93 and the transport belt 85, which are sheet contact members immediately located at the inlet and outlet sides of the second-transfer region TR, is set to be shorter than the length ds, in the transport direction, of a minimum-size sheet usable as a low-resistance sheet Sm. Therefore, at least in the transporting process in which the sheet S passes through the second-transfer region TR, the sheet S is disposed astride the second-transfer region TR and the guide chute 93 or the transport belt 85.

Drive Control System of Image Forming Apparatus

As shown in FIG. 3, in this exemplary embodiment, reference sign 120 denotes a controller that controls the image forming operation of the image forming apparatus. The controller 120 is constituted of a microcomputer including a central processing unit (CPU), a read-only memory (ROM), a random access memory (RAM), and an input-output interface. The controller 120 imports, via the input-output interface, switch signals and various types of sensor signals from a start switch (not shown) and a mode selection switch for selecting an image forming mode, as well as various types of input signals, such as a sheet determination signal, from the determining unit 110 for determining the sheet type, causes the CPU to execute an image-formation control program (see FIG. 6) preliminarily stored in the ROM, generates control signals for drive control targets, and subsequently transmits the control signals to the respective drive control targets (such as the selection switch 64).

Operation of Image Forming Apparatus

Figure 6:
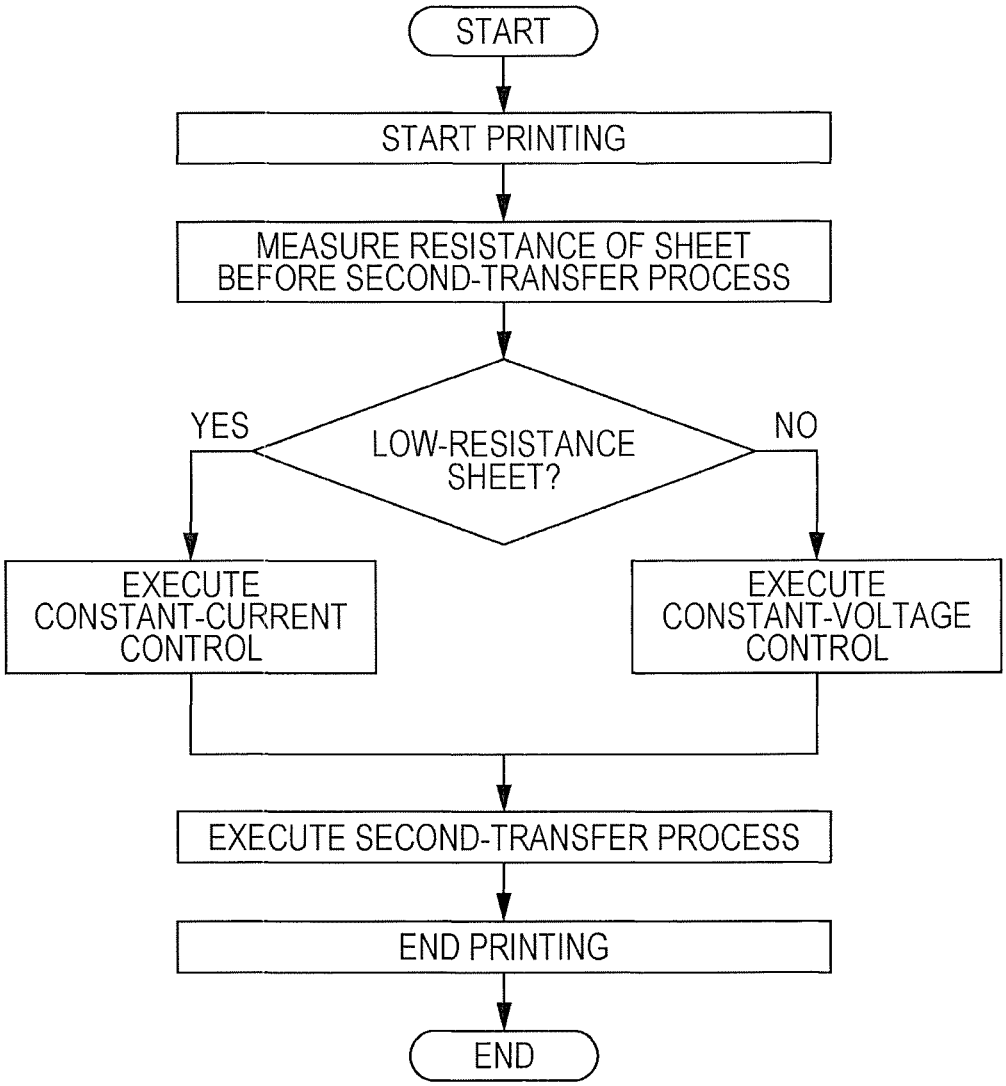
FIG. 6 is a flowchart illustrating a sheet-type image forming sequence used in the image forming apparatus according to the first exemplary embodiment.

Assuming that sheets S with different surface resistance values are used in a mixed fashion in the image forming apparatus shown in FIG. 2, printing operation (i.e., image forming operation) by the image forming apparatus is started by turning on a start switch (not shown), as shown in FIG. 6.

In this case, a sheet S is fed from the sheet feed container 81 or 82 or from the manual sheet feeder 92 and is transported toward the second-transfer region TR via a predetermined transport path. Before the sheet S reaches the second-transfer region TR, the determining unit 110 measures the surface resistance of the sheet S (i.e., performs a sheet-type determination process).

The controller 120 determines whether or not the sheet S is a low-resistance sheet based on the determination result of the determining unit 110. If the sheet S is a low-resistance sheet, a feedback circuit including the constant-current control circuit 61 is selected by using the selection switch 64, so that constant-current control is executable.

In contrast, if the controller 120 determines that the sheet S is not a low-resistance sheet, the feedback circuit is disabled by using the selection switch 64, and constant-voltage control is executed by the transfer power source 60.

Subsequently, when the sheet S reaches the second-transfer region TR, images G formed at the image forming sections 22 (22*a* to 22*f*) and first-transferred to the intermediate transfer member 30 are second-transferred onto the sheet S. Then, the sheet S undergoes a fixing process performed by the fixing device 70 and is output onto the sheet output tray 86, whereby the sequential printing operation (image forming operation) ends.

Second-Transfer Process

High-Resistance Sheet

Figure 7A:
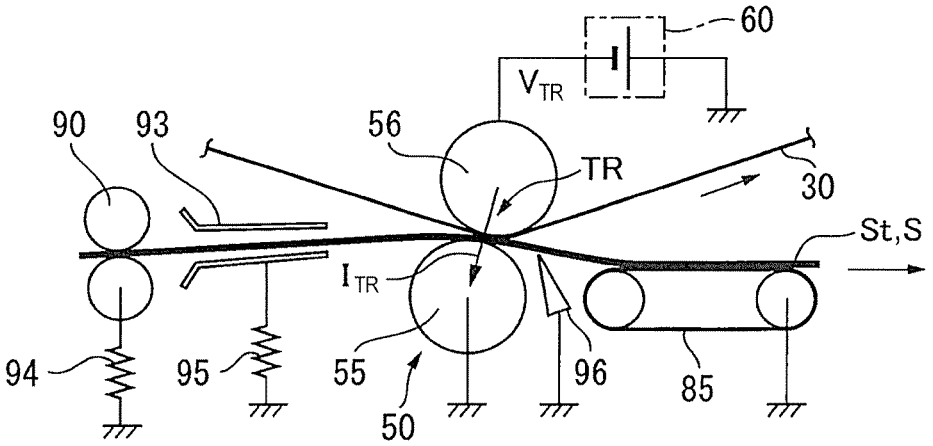
FIG. 7A schematically illustrates a transfer process performed on a high-resistance sheet by the second-transfer section of the image forming apparatus according to the first exemplary embodiment, and FIG. 7B schematically illustrates a transfer process performed on a low-resistance sheet by the second-transfer section.

In a case where the sheet S is a high-resistance sheet St (widely including sheets other than a low-resistance sheet Sm and including plain paper), the feedback circuit including the constant-current control circuit 61 is not selected, as shown in FIGS. 3, 6, and 7A, so that the transfer voltage $V_{TR}$ from the transfer power source 60 is applied from the feed roller 57 toward the opposing roller 56 in the second-transfer region TR. Thus, a transfer electric field is generated from the intermediate transfer member 30 side, thereby causing the transfer current to flow toward the transfer roller 55.

In this state, the high-resistance sheet St reaches the second-transfer region TR via the positioning roller 90 and the guide chute 93, and the images G on the intermediate transfer member 30 are second-transferred onto the sheet S in the second-transfer region TR. In this case, even if the high-resistance sheet St comes into contact with the positioning roller 90, the guide chute 93, or the transport belt 85 while the high-resistance sheet St passes through the second-transfer region TR, the surface resistance of the high-resistance sheet St is high enough so that the transfer operation is stably performed on the high-resistance sheet St in the second-transfer region TR without a portion of the transfer current in the second-transfer region TR leaking via the high-resistance sheet St as a current path leading to the ground for the positioning roller 90, the guide chute 93, or the transport belt 85, thereby preventing the occurrence of trouble, such as reduced image density in a part of the high-resistance sheet St.

Low-Resistance Sheet

The following description relates to a case where the sheet S is a low-resistance sheet (e.g., metallic sheet) Sm.

Figure 7B:
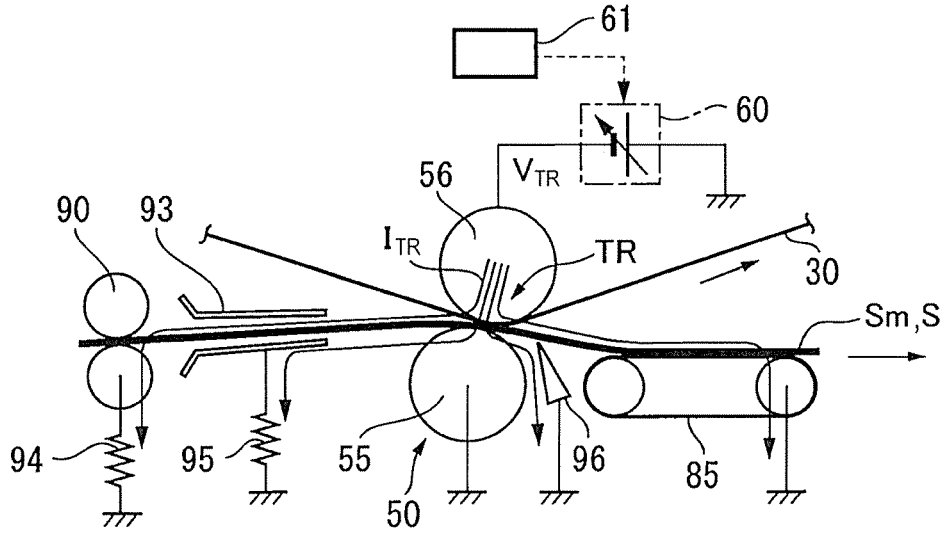

In this case, as shown in FIGS. 3, 6, and 7B, the controller 120 causes the feedback circuit including the constant-current control circuit 61 to execute constant-current control via the selection switch 64.

Therefore, the transfer voltage $V_{TR}$ constant-current-controlled by the transfer power source 60 is applied from the feed roller 57 toward the opposing roller 56 in the second-transfer region TR, so that a transfer electric field is generated from the intermediate transfer member 30 side.

In this state, the low-resistance sheet Sm passes through the second-transfer region TR via the positioning roller 90 and the guide chute 93 and travels while moving into contact with or in close proximity to the antistatic needle 96 and the transport belt 85. As shown in FIG. 7B, the low-resistance sheet Sm is disposed in contact with the positioning roller 90, the guide chute 93, and the transport belt 85 at the inlet and outlet sides of the second-transfer region TR, and is disposed in close proximity to the antistatic needle 96.

Figure 8A:
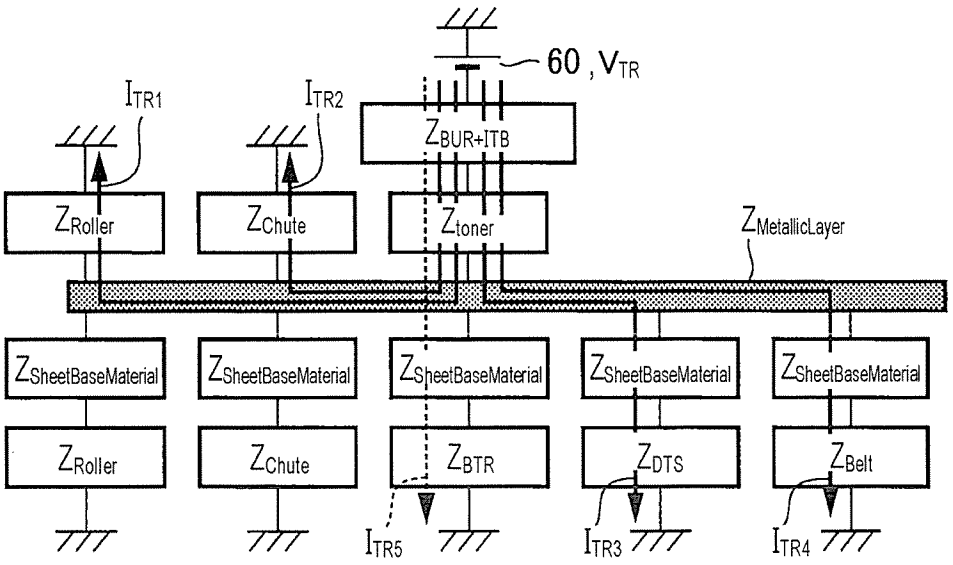
FIGS. 8A and 8B each illustrate an equivalent circuit of the low-resistance sheet passing through the second-transfer section, FIG. 8A schematically illustrating the flow of transfer current in the transfer process performed on the low-resistance sheet, FIG. 8B schematically illustrating the flow of transfer current in the transfer process performed on the low-resistance sheet at front and back sides of the position of the low-resistance sheet.

FIG. 8A schematically illustrates an equivalent circuit in which the impedance of each component in and around the second-transfer region TR according to this exemplary embodiment is defined as follows.

$Z_{BUR+ITB}$: Impedance of Opposing Roller 56 and Intermediate Transfer Member 30

$Z_{BTR}$: Impedance of Transfer Roller 55

$Z_{toner}$: Impedance of Toner $Z_{SheetBaseMaterial}$: Impedance of Base Layer 100 of Low-Resistance Sheet Sm $Z_{MetallicLayer}$: Impedance of Metallic Layer 101 of Low-Resistance Sheet Sm $Z_{Roller}$: Impedance of Positioning Roller 90

$Z_{Chute}$: Impedance of Guide Chute 93

$Z_{BTR}$: Impedance of Transfer Roller 55

$Z_{DTS}$: Impedance of Antistatic Needle 96

$Z_{Belt}$: Impedance of Transport Belt 85

In FIG. 8A, $V_{TR}$ denotes a transfer voltage and $I_{TR}$ (specifically, $I_{TR1}$ to $I_{TR4}$) denotes a transfer current.

In the equivalent circuit shown in FIG. 8A, when the constant-current-controlled transfer voltage $V_{TR}$ is applied to the second-transfer region TR, since the metallic layer 101 of the low-resistance sheet Sm is disposed astride the positioning roller 90, the guide chute 93, the antistatic needle 96, and the transport belt 85 and the impedances $Z_{Roller}$ and $Z_{chute}$ of the positioning roller 90 and the guide chute 93 and the impedances $Z_{DTS}$ and $Z_{Belt}$ of the antistatic needle 96 and the transport belt 85 are set to be lower than the impedance $Z_{BTR}$ of the transfer roller 55, the transfer current $I_{TR}$ in the second-transfer region TR flows to paths leading to the ground for the positioning roller 90, the guide chute 93, the antistatic needle 96, and the transport belt 85 via the metallic layer 101 of the low-resistance sheet Sm as a current path after passing through the toner layer serving as the image G, as indicated by $I_{TR1}$ to $I_{TR4}$ in FIG. 8A. In this case, since the impedance $Z_{BTR}$ of the transfer roller 55 is set to be high to a certain extent, there is hardly any flow of the transfer current $I_{TR5}$ indicated by a dotted line in FIG. 8A.

In this state, the currents $I_{TR1}$ to $I_{TR4}$ flowing distributively to the contact members coming into contact with the low-resistance sheet Sm or the proximity members coming into close proximity to the low-resistance sheet Sm are set depending on the respective impedances $Z_{Roller}$, $Z_{Chute}$, $Z_{DTS}$, and $Z_{Belt}$, but since the transfer current $I_{TR}$ in the second-transfer region TR is the sum of the currents $I_{TR1}$ to $I_{TR4}$ flowing distributively to the contact members coming into contact with the low-resistance sheet Sm or the proximity members coming into close proximity to the low-resistance sheet Sm, the transfer current $I_{TR}$ in the second-transfer region TR is no longer dependent on the contact members or proximity members.

Figure 8B:
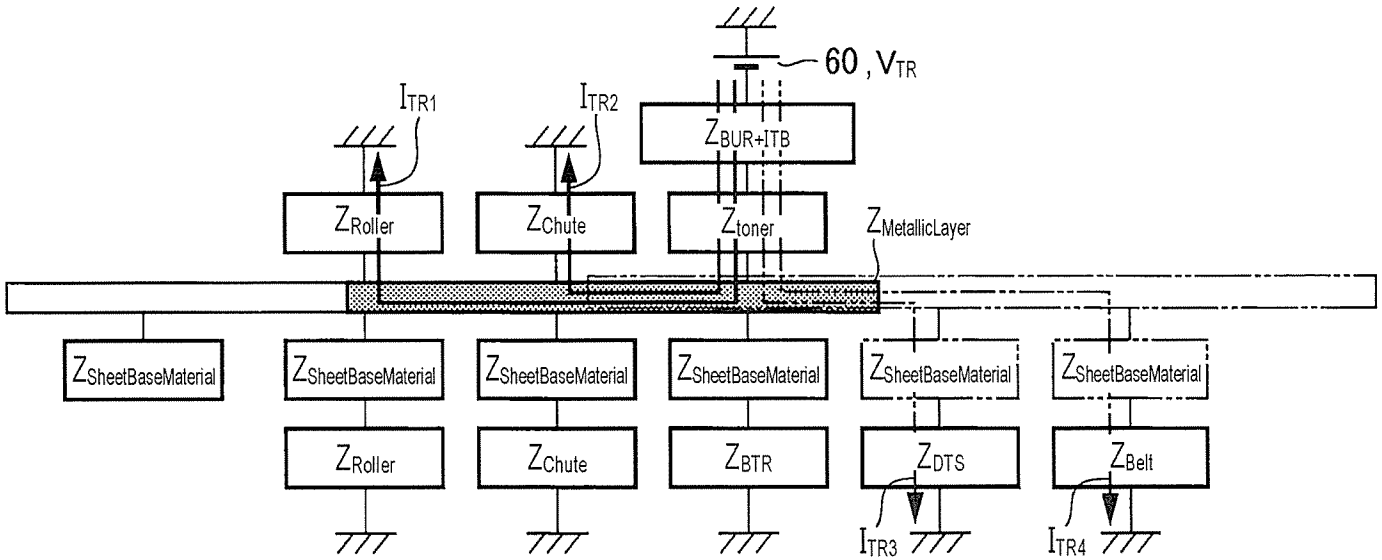

In a case where the low-resistance sheet Sm travels at a position upstream, in the transport direction, of the position of the low-resistance sheet Sm shown in FIG. 8A, for example, when the leading edge of the low-resistance sheet Sm passes through the second-transfer region TR, the low-resistance sheet Sm is disposed in contact with the positioning roller 90 and the guide chute 93 at the inlet side of the second-transfer region TR, as indicated by a solid line in FIG. 8B. In this state, the transfer current $I_{TR}$ in the second-transfer region TR flows to paths leading to the ground for the positioning roller 90 and the guide chute 93 via the metallic layer 101 of the low-resistance sheet Sm as a current path, as indicated by $I_{TR1}$ and $I_{TR2}$ in FIG. 8B. In this case, the transfer current $I_{TR}$ flows via the impedances $Z_{Roller}$ and $Z_{Chute}$ of the positioning roller 90 and the guide chute 93, but it is clear that the impedance of the current path through which the transfer current $I_{TR}$ flows has changed, as compared with the case of the transport position in FIG. 8A. However, since the transfer current $I_{TR}$ is controlled to a constant current by the constant-current control circuit 61 in this example, there is no concern that the transfer current $I_{TR}$ may change even if there is a change in the impedance of the current path.

In a case where the low-resistance sheet Sm travels at a position downstream, in the transport direction, of the position of the low-resistance sheet Sm shown in FIG. 8A, for example, when the trailing edge of the low-resistance sheet Sm passes through the second-transfer region TR, the low-resistance sheet Sm is disposed in contact with the antistatic needle 96 and the transport belt 85 at the outlet side of the second-transfer region TR, as indicated by a two-dot chain line in FIG. 8B. In this state, the transfer current $I_{TR}$ in the second-transfer region TR flows to paths leading to the ground for the antistatic needle 96 and the transport belt 85 via the metallic layer 101 of the low-resistance sheet Sm as a current path, as indicated by $I_{TR3}$ and $I_{TR4}$ in FIG. 8B. In this case, the transfer current $I_{TR}$ flows via the impedances $Z_{DTS}$ and $Z_{Belt}$ of the antistatic needle 96 and the transport belt 85, but it is clear that the impedance of the current path through which the transfer current $I_{TR}$ flows has changed, as compared with the case of the transport position in FIG. 8A or the case indicated by the solid line in FIG. 8B. However, since the transfer current $I_{TR}$ is controlled to a constant current by the constant-current control circuit 61 in this example, there is no concern that the transfer current $I_{TR}$ may change even if there is a change in the impedance of the current path.

Accordingly, in this exemplary embodiment, the length d of the sheet transport path between the guide chute 93 and the transport belt 85 located at the inlet and outlet sides of the second-transfer region TR is set to be shorter than the length ds, in the transport direction, of the low-resistance sheet Sm, so that the low-resistance sheet Sm is in contact with at least one contact member located at the inlet or outlet side of the second-transfer region TR while the low-resistance sheet Sm passes through the second-transfer region TR. Thus, by generating a transfer electric field from the intermediate transfer member 30 side, a constant transfer current $I_{TR}$ stably flows to a toner image as an image G located between the intermediate transfer member 30 and the low-resistance sheet Sm in the second-transfer region TR.

Furthermore, even if the impedance of the current path changes during the transporting process of the low-resistance sheet Sm, the transfer current $I_{TR}$ flowing through the second-transfer region TR is controlled to a constant current by the constant-current control circuit 61. Thus, for example, even in a case where a halftone image is formed on the low-resistance sheet Sm, the transfer current $I_{TR}$ does not change rapidly, and there is no concern that uneven image densities may occur as a result of insufficient transfer current $I_{TR}$.

Improvement with Regard to Effect on Sheet Width by Constant-Current Control

Figure 5B:
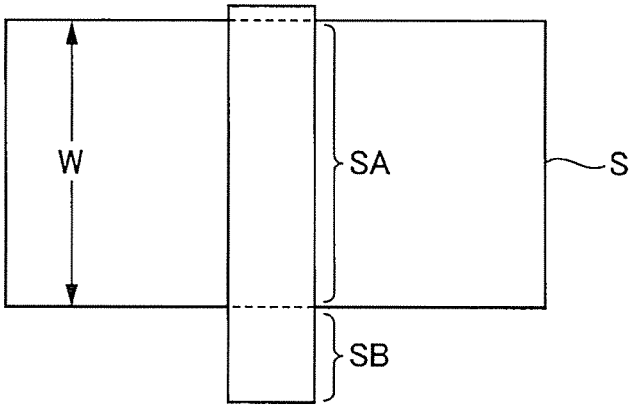
FIG. 5B is a diagram as viewed from a direction of an arrow VB in FIG. 5A.

As shown in FIG. 5B, in a case where a dimension w in the width direction intersecting the transport direction of the sheet S is shorter than the length, in the axial direction, of the transfer roller 55 of the second-transfer device 50, the transfer roller 55 has a passing section SA through which the sheet S passes and a non-passing section SB through which the sheet S does not pass.

Normally, constant-current control is affected by the sheet width when there is too much transfer current leaking to the non-passing section SB located at the outer side of the passing section SA. If the electric current simply leaks in accordance with the area ratio between the passing section SA and the non-passing section SB, there is no effect on transferability. If a uniform current density is achieved in the axial direction of the nip region of the second-transfer region TR, an electric current (i.e., an electric field) necessary for the toner layer is obtained. However, the impedance of the passing section SA is higher than that of the non-passing section SB by an amount equivalent to the impedances $Z_{toner}$ and $Z_{sheetBaseMaterial}$ of the toner layer and the sheet base material, thus causing the electric current to flow inevitably toward the non-passing section SB. Therefore, in a case where the same transfer current is fed from the intermediate transfer member 30 side, the current density in the passing section SA inevitably becomes insufficient. This implies that the transfer electric field acting on the toner layer is insufficient, thus causing a transfer defect.

However, in this exemplary embodiment, even when constant-current control is executed on the low-resistance sheet Sm, the phenomenon of the transfer current $I_{TR}$ leaking toward the non-passing section SB is minimized in accordance with the following reasons.

In this exemplary embodiment, the grounding conditions (i.e., impedance conditions) for the contact members (such as the positioning roller 90, the guide chute 93, and the transport belt 85) that are disposed at the inlet and outlet sides of the second-transfer region TR and that are to come into contact with the low-resistance sheet Sm are set to be lower than the impedance of the transfer roller 55, as indicated by expression 1 below.

$$Z_{Roller}, Z_{Chute}, Z_{Belt} < Z_{BTR} \quad (1)$$

Figure 9A:
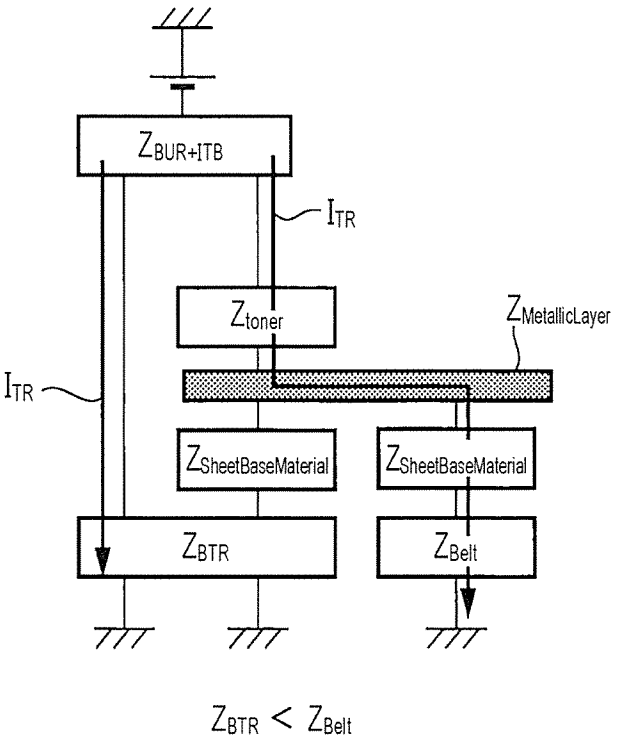
FIG. 9A schematically illustrates the flow of transfer current in a passing section and a non-passing section when the low-resistance sheet passes through the second-transfer section of the image forming apparatus according to the first exemplary embodiment, and FIG. 9B schematically illustrates the flow of transfer current in a passing section and a non-passing section when the low-resistance sheet passes through a second-transfer section of an image forming apparatus according to a first comparative example.

As shown in FIG. 9A, for example, assuming that the low-resistance sheet Sm passes through the second-transfer region TR and the low-resistance sheet Sm reaches the transport belt 85, since the impedance $Z_{Belt}$ of the transport belt 85 is set to be lower than the impedance $Z_{BTR}$ of the transfer roller 55, the transfer current $I_{TR}$ of the second-transfer region TR in the passing section SA flows to a path leading to the ground for the transport belt 85 via the metallic layer 101 of the low-resistance sheet Sm as a current path after passing through the toner layer on the intermediate transfer member 30. In this case, the transfer roller 55 and the intermediate transfer member 30 come directly into contact with each other in the non-passing section SB, and a portion of the transfer current $I_{TR}$ may possibly flow thereto. However, the percentage of the transfer current $I_{TR}$ of the second-transfer region TR flowing to the passing section SA increases due to the difference in impedance between the transport belt 85 and the transfer roller 55. Consequently, unevenness in current density between the passing section SA and the non-passing section SB is suppressed, so that the effect caused by the width of the low-resistance sheet Sm may be minimized.

Although this example has been described with reference to the transport belt 85 as an example, the effect caused by the width of the low-resistance sheet Sm may be minimized in accordance with similar reasons in a state where the low-resistance sheet Sm comes into contact with the positioning roller 90 or the guide chute 93 located at the inlet side of the second-transfer region TR.

FIRST COMPARATIVE EXAMPLE

In order to evaluate the minimization capability against the effect caused by the width of the low-resistance sheet Sm in and around the second-transfer section of the image forming apparatus according to this exemplary embodiment, the behavior in and around a second-transfer section of an image forming apparatus according to a first comparative example will be described.

The structure of and around the second-transfer section according to this comparative example is substantially similar to that in the first exemplary embodiment but differs from that in the first exemplary embodiment in that the grounding conditions (i.e., impedance conditions) for the contact members (such as the positioning roller 90, the guide chute 93, and the transport belt 85) that are disposed at the inlet and outlet sides of the second-transfer region TR and that are to come into contact with the passing section SA are set to be higher than the impedance of the transfer roller 55, as indicated by expression 2 below.

$$Z_{Roller}, Z_{Chute}, Z_{Belt} > Z_{BTR} \quad (2)$$

Figure 9B:
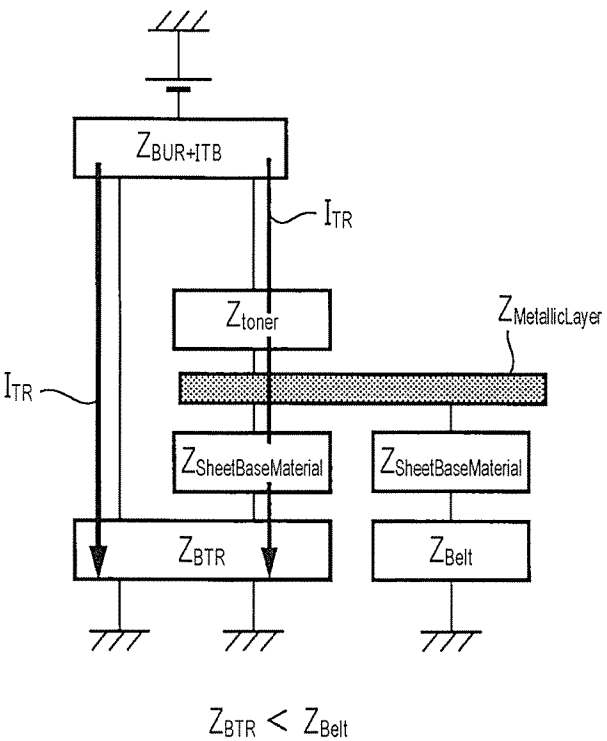

As shown in FIG. 9B, for example, assuming that the low-resistance sheet Sm passes through the second-transfer region TR and the low-resistance sheet Sm reaches the transport belt 85, since the impedance $Z_{Belt}$ of the transport belt 85 is set to be higher than the impedance $Z_{BTR}$ of the transfer roller 55, the transfer current $I_{TR}$ of the second-transfer region TR in the passing section SA flows to a path leading to the ground for the transfer roller 55 via the low-resistance sheet Sm after passing through the toner layer on the intermediate transfer member 30. In contrast, in the non-passing section SB, the transfer roller 55 and the intermediate transfer member 30 come directly into contact with each other, and a portion of the transfer current $I_{TR}$ may possibly flow thereto. Since the impedance of the non-passing section SB in lower than that of the passing section SA by an amount equivalent to the $Z_{toner}$ and $Z_{SheetBaseMaterial}$ of the toner layer and the sheet base material of the low-resistance sheet Sm, the transfer current $I_{TR}$ of the second-transfer region TR tends to flow more toward the non-passing section SB than toward the passing section SA. Therefore, in a case where the same transfer current is fed from the intermediate transfer member 30 side, the current density in the passing section SA inevitably becomes insufficient, possibly leading to a transfer defect.

Second Exemplary Embodiment

Figure 10:
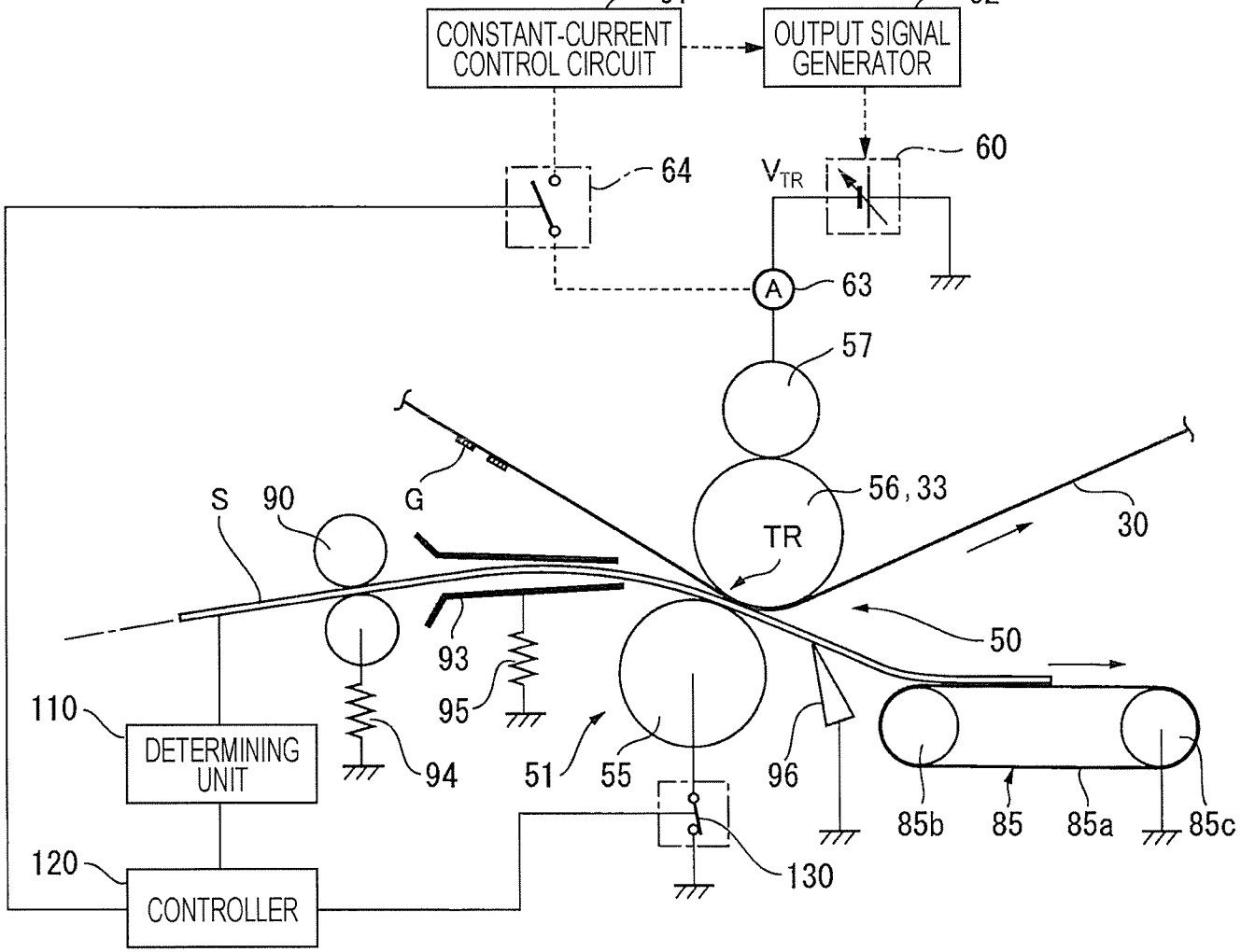
FIG. 10 illustrates a relevant part of and around a second-transfer section of an image forming apparatus according to a second exemplary embodiment.

FIG. 10 illustrates a relevant part of and around a second-transfer section of an image forming apparatus according to a second exemplary embodiment.

In FIG. 10, the configuration of and around the second-transfer section of the image forming apparatus is substantially similar to that in the first exemplary embodiment but differs from that in the first exemplary embodiment in that the transfer roller 55 of the second-transfer device 50 is switchable between a grounded state and a non-grounded state by using a switch 130 and that the controller 120 causes the switch 130 to switch the transfer roller 55 to a non-grounded state when the determining unit 110 determines that the sheet S is a low-resistance sheet Sm. Components identical to those in the first exemplary embodiment are given the same reference signs as those used in the first exemplary embodiment, and detailed descriptions thereof will be omitted.

This exemplary embodiment exhibits effects substantially similar to those of the image forming apparatus according to the first exemplary embodiment but differs from the first exemplary embodiment in that the transfer roller 55 of the second-transfer device 50 is set in a non-grounded state (i.e., floating state) when a low-resistance sheet Sm is used.

Therefore, in this exemplary embodiment, when the low-resistance sheet Sm, such as a metallic sheet, passes through the second-transfer region TR, the transfer voltage $V_{TR}$ from the transfer power source 60 is applied from the feed roller 57 toward the opposing roller 56 via the constant-current control circuit 61, as in the first exemplary embodiment, so that a transfer electric field is generated in the second-transfer region TR from the intermediate transfer member 30 side. Thus, the transfer current $I_{TR}$ flows along the metallic layer 101 of the low-resistance sheet Sm and flows to a path leading to the ground from the members (i.e., the positioning roller 90, the guide chute 93, the antistatic needle 96, and the transport belt 85) coming into contact with or into close proximity to the low-resistance sheet Sm. Since the transfer roller 55 is in a non-grounded state in this example, a portion of the transfer current $I_{TR}$ does not flow toward the transfer roller 55.

Accordingly, in this exemplary embodiment, the current path to the transfer roller 55 is completely blocked off when a low-resistance sheet Sm is used. Therefore, although there is a concern in the first exemplary embodiment that a portion of the transfer current $I_{TR}$ may flow as a leaking current toward the transfer roller 55 via the passing section and the non-passing section, a portion of the transfer current $I_{TR}$ may be prevented from leaking toward the transfer roller 55 in this exemplary embodiment, regardless of the passing section and the non-passing section. As an alternative to this exemplary embodiment in which the switching to the non-grounded state is performed by using the switch 130, it is possible to perform switching to the ground via a resistor with a resistance value sufficiently higher than the impedances of the contact members.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a transfer unit that nips a recording medium by using an image retaining unit, which retains an image by using a charged imaging particle, and a transfer member and that generates a transfer electric field from the image-retaining-unit side in a transfer region between the image retaining unit and the transfer member so as to electrostatically transfer the image retained by the image retaining unit onto the recording medium; and at least one contact unit provided at each of an upstream side and a downstream side of the transfer region of the transfer unit in a transport direction of the recording medium, and the contact unit at the upstream side being a positioning member, wherein at least one of the contact units at the upstream side comes into contact with the recording medium while the recording medium passes through the transfer region, so as to function as an electrode leading to a ground, and at least another one of the contact units at the upstream side being a positioning member that positions the recording medium, wherein a resistance leading to the ground for each contact unit is lower than a resistance of the transfer member of the transfer unit, wherein the transfer unit switches the transfer member from a grounded state to a non-grounded state when a low-resistance recording medium is used as the recording medium, and wherein the contact units respectively provided at the upstream side and the downstream side of the transfer region in the transport direction of the recording medium are separated from each other by a distance shorter than a length of the recording medium in the transport direction.

2. An image forming apparatus comprising:

transfer means for nipping a recording medium by using image retaining means, which retains an image by using a charged imaging particle, and a transfer member and that generates a transfer electric field in a transfer region between the image retaining means and the transfer member so as to electrostatically transfer the image retained by the image retaining means onto the recording medium;

contact means that is provided at an upstream side and a downstream side of the transfer region in a transport direction of the recording medium and at least one member of the contact means at the upstream side comes into contact with the recording medium while the recording medium passes through the transfer region, so as to function as an electrode leading to a ground, and at least another one member of the contact means at the upstream side being a positioning member that positions the recording medium; and constant-current control means for performing constant-current control on a transfer current to be fed to the transfer region by using a transfer voltage applied from a transfer power source in a condition in which the recording medium is a low-resistance recording medium having a predetermined resistance value or lower or having an electrically-conductive layer along a medium base surface, wherein the transfer means switches the transfer member from a grounded state to a non-grounded state when the low-resistance recording medium is used.

3. An image forming apparatus comprising:

a transfer unit that nips a recording medium by using an image retaining unit, which retains an image by using a charged imaging particle, and a transfer member and that generates a transfer electric field in a transfer region between the image retaining unit and the transfer member so as to electrostatically transfer the image retained by the image retaining unit onto the recording medium;

a contact unit that is provided at an upstream side and a downstream side of the transfer region in a transport direction of the recording medium and at least one member of the contact unit comes into contact with the recording medium while the recording medium passes through the transfer region, so as to function as an electrode leading to a ground; and a constant-current controller that performs constant-current control on a transfer current to be fed to the transfer region by using a transfer voltage applied from a transfer power source in a condition in which the recording medium is a low-resistance recording medium having a predetermined resistance value or lower or having an electrically-conductive layer along a medium base surface, wherein the transfer unit switches the transfer member from a grounded state to a non-grounded state when the low-resistance recording medium is used.

4. The image forming apparatus according to claim 1, further comprising:

a determining unit that is capable of determining a type of recording medium traveling toward the transfer region, wherein the constant-current controller is determined as being necessary or not based on a determination signal of the determining unit.

5. The image forming apparatus according to claim 4, wherein the determining unit is a detector that detects whether or not the traveling recording medium is of a low resistance type.

6. The image forming apparatus according to claim 1, further comprising:

a selecting unit that selects the constant-current controller when the recording medium is of a low-resistance type and that selects a constant-voltage controller when the recording medium is of a non-low-resistance type.

7. The image forming apparatus according to claim 1, wherein a resistance leading to the ground for the contact unit is lower than a resistance of the transfer member of the transfer unit.

8. The image forming apparatus according to claim 1, wherein the contact unit includes a plurality of members that are respectively provided at the upstream side and the downstream side of the transfer region in the transport direction of the recording medium and that are separated from each other by a distance shorter than a length of the recording medium in the transport direction.

9. The image forming apparatus according to claim 8, wherein, when the low-resistance recording medium passes through the transfer region, at least one of the member of the contact unit located at an inlet side of the transfer region and the member of the contact unit located at an outlet side of the transfer region functions as the electrode leading to the ground for the recording medium.

10. The image forming apparatus according to claim 1, wherein the image retaining unit is an intermediate transfer member to and on which an image on an image-formation retaining member is intermediately transferred and retained before the image is to be transferred onto the recording medium, and wherein the transfer unit transfers the image on the intermediate transfer member onto the recording medium.

* * * * *